United States Patent [19]

Demessemaekers et al.

[11] 4,017,409

[45] Apr. 12, 1977

[54] LIQUID HOUSEHOLD CLEANER

[75] Inventors: Emiel Mathilde Anna Alfons Demessemaekers, Cincinnati, Ohio; Guido Bognolo, Brussels, Belgium; Gianfranco Luigi Spadini, Newcastle upon Tyne, England

[73] Assignee: The Procter & Gamble Company, Cincinnati, Ohio

[22] Filed: Jan. 20, 1976

[21] Appl. No.: 650,815

[52] U.S. Cl. ..... 252/109; 252/121; 252/358; 252/526; 252/531; 252/533; 252/535; 252/545; 252/550; 252/552; 252/554

[51] Int. Cl.[2] ..... C11D 1/14; C11D 1/37; C11D 3/06

[58] Field of Search ..... 252/550, 552, 554, 531, 252/533, 535, 121, 108, 109, 321, 358, DIG. 14

[56] References Cited

UNITED STATES PATENTS

| | | | |
|---|---|---|---|
| 2,860,107 | 11/1958 | Lamberti et al. | 252/539 X |
| 2,954,347 | 9/1960 | St. John et al. | 252/109 |
| 3,009,882 | 11/1961 | Clarke et al. | 252/116 |
| 3,433,574 | 3/1969 | Dürsch et al. | 8/99 |
| 3,527,707 | 9/1970 | McAteer et al. | 252/535 |
| 3,707,503 | 12/1972 | Kenney | 252/117 |
| 3,794,589 | 2/1974 | Fishman | 252/110 |
| 3,931,033 | 1/1976 | Löhr et al. | 252/122 |

FOREIGN PATENTS OR APPLICATIONS

| | | |
|---|---|---|
| 1,296,481 | 5/1962 | France |
| 980,543 | 1/1965 | United Kingdom |

OTHER PUBLICATIONS

Ross, "Chemical Antifoaming Agent," Chemical Industries, May 1949, pp. 757–759.

*Primary Examiner*—P.E. Willis, Jr.
*Attorney, Agent, or Firm*—Douglas C. Mohl; Ronald L. Hemingway; Richard C. Witte

[57] ABSTRACT

Stable, homogeneous, easily dispensable, liquid household cleaning compositions containing a mixture of specific, synthetic, organic, anionic detersive surfactants; the Ca- and Mg salts of which are hardly soluble in water; a relatively low level of builder salts; fatty acid soap and fatty ester; and water.

8 Claims, No Drawings

LIQUID HOUSEHOLD CLEANER

FIELD OF THE INVENTION

This invention relates to liquid household cleaner compositions, designed in particular for cleaning hard surfaces, most effective in hard water, having a low builder concentration and a unique suds depressing system.

BACKGROUND OF THE INVENTION

Household cleaner compositions have become widely accepted in recent years for cleaning hard surfaces, e.g., tiled walls, wash-basins, bath-tubs, wooden panels, windows, ceramic floors, washable wall-paper, painted surfaces, etc. To obtain liquid cleaner compositions as effective as granular or powdered cleaning compositions, it was considered essential that liquid cleaner compositions contain levels of builder salts as high as in said granular or powdered cleaning compositions. It has proven difficult, however, to formulate liquid, aqueous household cleaner compositions, having the same levels of builder salts, to achieve comparable cleaning efficiency, particularly if said liquid cleaner compositions are to be stable, homogenous and easily dispensable.

Stable, homogenous, liquid cleaner compositions with high levels of builder salts are not only difficult to manufacture, but they show poor filming, spotting and streaking performance, particularly on shiny hard surfaces, and therefore require elaborate rinsing of the cleaned surfaces. Liquid cleaner compositions containing low levels of builder salts but higher levels of synthetic surfactants to achieve comparable cleaning efficiency have the negative of high sudsing, which also requires elaborate rinsing of the cleaned surfaces.

Most cleaner compositions are effective in removing either inorganic soil or organic soil. Achieving equal efficiency in removing both inorganic soil and organic soil, particularly greasy soil, with a built household cleaner, has been proven extremely difficult, however, because very often any improvement of said cleaners on inorganic soil removal results in a loss on grease removal and vice-versa.

OBJECTS OF THE INVENTION

Accordingly, it is an object of the present invention to provide a liquid, homogeneous, stable, easily dispensable household cleaner composition, having improved, i.e., both inorganic and lipid soil removal properties, designed in particular for cleaning hard surfaces, especially shiny, glassy or vitreous and metal surfaces.

It is a further object of the present invention to provide a liquid household cleaner composition which does not require additional rinsing and wiping, leaving practically no visible builder salt or water hardness residues on the cleaned surfaces.

It is another object of the present invention to provide a liquid household cleaner composition with a low sudsing profile independent of the water hardness and type and level of soil.

SUMMARY OF THE INVENTION

The instant, liquid, homogeneous, stable, easily dispensable cleaner compositions consist essentially of:

A. from about 2% to about 15% by weight of a mixture of a. an anionic, organic, synthetic sulfonate having the formula $R_1SO_3M$ wherein $R_1$ is selected from the group consisting of alkyl groups containing from 10 to 20 carbon atoms, and wherein M represents a cation selected from the group consisting of sodium, potassium, ammonium and ethanol ammonium; and b. an anionic, organic, synthetic sulfate having the formula $R_2SO_4M$ wherein $R_2$ is selected from the group consisting of saturated or unsaturated, straight or branched aliphatic hydrocarbon groups containing from 8 to 18 carbon atoms; and M has the meaning given above;

whereby the weight ratio of (a) to (b) is between 3/2 and 10/1;

B. from about 3% to about 7.5% by weight of a water-soluble, organic or inorganic builder salt; and mixtures thereof;

C. from about 0.3% to about 3% by weight of a suds suppressing system comprising a fatty acid ester of the general formula $R_3COOR_4$, wherein $R_3$ is an alkyl radical containing from 11 to 17 carbon atoms and $R_4$ is an alkyl radical containing from 2 to 4 carbon atoms; and sodium, potassium or ammonium soap of a fatty acid containing from 12 to 18 carbon atoms; whereby the ester/soap weight ratio is between 1/1 and 1/20; and D. water;

wherein the weight ratio of (A) to (B) is between 5/1 and 1/2. Preferred liquid cleaner compositions consist essentially of:

A. from about 2% to about 15% by weight of:

a. a secondary paraffin sulfonate wherein the paraffin-derived alkyl radical contains from 14 to 16 carbon atoms, b. a saturated, straight chain alkyl sulfate having 12 to 14 carbon atoms, whereby the weight ratio of (a) to (b) is between 3/2 and 10/1;

B. from about 3% to about 7.5% by weight of a mixture of sodium tripolyphosphate and sodium hexametaphosphate in a weight ratio between 5/1 and 1/1;

C. from about 0.4% to about 1.5% by weight of coconut potassium soap and from about 0.05% to about 0.6% of isopropylmyristate wherein the ester/soap weight ratio is between 1/5 and 1/20; and D. water;

wherein the weight ratio of (A) to (B) is between 5/1 and 1/2.

Other preferred liquid cleaner compositions consist essentially of:

A. from about 6% to about 10% by weight of a. a secondary paraffin sulfonate wherein the paraffin-derived alkyl radical contains from 14 to 16 carbon atoms;

b. a saturated straight chain alkyl sulfate having 12 to 14 carbon atoms; whereby the ratio of (a) to (b) is between 5/1 and 10/1;

B. from about 3% to about 6% by weight of a mixture of sodium tripolyphosphate and sodium hexametaphosphate in a weight ratio of about 3/1;

C. from about 0.4% to about 0.8% by wt. of coconut potassium soap and from about 0.05% to about 0.2% of isopropylmyristate wherein the ester/soap weight ratio is about 1/10; and D. water;

wherein the weight ratio of (A) to (B) is between 3/1 and 1/1.

DETAILED DESCRIPTION OF THE INVENTION

The stable, homogeneous, easily dispensable, liquid household cleaner compositions of the instant invention consist essentially of four components, i.e., a mixture of anionic, organic, synthetic, detersive surfactants selected from the group consisting of sulfonates having the general formula $R_1SO_3M$, and sulfates having the general formula $R_2SO_4M$, wherein $R_1$, $R_2$ and M have the meaning indicated above; an organic or inorganic builder salt, and mixtures thereof; a suds depressing system comprising a fatty acid ester $R_3COOR_4$, wherein $R_3$ and $R_4$ have the meaning indicated above, and a fatty acid soap; and water.

Each of these essential composition components and their relation to one another, essential to achieve the objects of the instant invention, as well as optional components that can be added in small amounts to increase the acceptability of the cleaner composition are discussed in detail hereinafter.

It is known that the Ca- and Mg salts, and particularly the Ca-salts of many synthetic, organic, anionic detersive surfactants as, for example, of paraffin sulfonic acid, alkylbenzene sulfonic acid, alkyl sulfuric acid, alkylethoxy sulfuric acid, are better grease removers - when solubilized - than the corresponding sodium, potassium, ammonium and substituted ammonium salts. However, most of said Ca-slats and especially the Ca-salts of secondary alkyl-, e.g., paraffin sulfonic acid having 10 to 20 carbon atoms in the alkyl or paraffin group ($C_{10-20}$ alkyl-$SO_3H$) and of aliphatic hydrocarbon sulfuric acid having 8 to 18 carbon atoms in the aliphatic hydrocarbon group ($C_{8-18}$ alkyl-$SO_4H$) are hardly soluble in water. Consequently, if used, their concentration has to be so low that no practical cleaning result can be achieved. If, on the other hand, a Ca-complexing compound is added in order to increase the ionic strength of the solution, shifting the equilibrium by complexing some of the calcium, such a high level of Ca-complexing compound, e.g., builder salt is needed, that no $Ca^{++}$, normally provided by the water hardness, is left over to form the desired Ca-salts of the detersive surfactants.

It has now surprisingly been found that a homogeneous, stable, easily dispensable cleaner composition is obtained, effective in removing both organic and inorganic soil, particularly lipid soil, by combining a mixture of selected anionic, synthetic detersive surfactants chosen from the group consisting of water-soluble sodium, potassium, ammonium and ethanol ammonium salts of paraffin sulfonic acid, preferably secondary paraffin sulfonic acid, and of aliphatic hydrocarbon sulfuric acid, with a relatively small amount of inorganic and/or organic builder salts.

Said cleaner composition, due to its relatively low level of builder salts, does not show any spotting, filming or streaking negatives either. However, it foams profusely. Therefore, a suds suppressing system with no negative effect on cleaning performance and surface appearance, stability and homogeneity, is to be added. It has now been found, and this is another surprising aspect of this invention, that a small amount of mixture of some specific fatty acid esters and fatty acid soap constitutes a unique, compatible suds depressing system, which makes it possible to maintain all the positive characteristics of the specific combination of selected detersive surfactants and builder salts, and to adjust its sudsing characteristics to any desired level by adapting the amount and in particular the weight ratio of fatty acid esters and soap, irrespective of the foaming capacity of the detersive surfactants, the level of builder salts, and the water hardness.

Specific, synthetic, organic, anionic detersive surfactants useful in the composition of the present invention include:

1. Water-soluble alkali-metal, ammonium and ethanol ammonium salts of alkyl sulfonic acid, having the general formula $R_1SO_3M$, wherein $R_1$ represents an alkyl group having from about 10 to about 20, preferably from about 14 to about 16 carbon atoms, and M is —Na, —K, —$NH_4$ and ethanol ammonium. Preferred are secondary alkyl sulfonates, and in particular n-paraffin sulfonates, having 14 to 16 carbon atoms. Important examples of alkyl sulfonic acid salts, e.g. secondary paraffin sulfonic acid salts, are the sodium and potassium paraffin sulfonates. Specific examples are sodium and potassium hexadecyl-, pentadecyl- and tetradecyl sulfonate.

2. Water-soluble alkali-metal, ammonium and ethanol ammonium salts, of a saturated or unsaturated, straight or branched aliphatic hydrocarbon sulfuric acid of the general formula $R_2SO_4M$, wherein $R_2$ represents an aliphatic hydrocarbon radical, having from 8 to 18, preferably from 12 to 14 carbon atoms, and M is —Na, —K, —$NH_4$ and ethanol ammonium. Said aliphatic hydrocarbon radical is preferably a straight alkyl radical. Important examples of said aliphatic hydrocarbon sulfuric acid salts (referred to hereinafter as alkyl sulfuric acid salts or alkyl sulfates) are the sodium and potassium alkyl sulfates, especially those obtained by sulfating higher alcohols containing 8 to 18 carbon atoms, and in particular alcohols derived from coconut oil. Specific useful examples are sodium and potassium dodecyl and tetradecyl sulfate.

The amounts of specific, synthetic, organic, anionic detersive surfactants useful in the composition of the present invention, i.e., the water-soluble salts of secondary paraffin sulfonic acid and alkyl sulfuric acid, can vary between 2 and 15% by weight, calculated on the total weight of the finished composition. This lower amount is required to obtain a minimum of cleaning power and in particular for grease-suspension. The maximum amount of 15% by weight is imposed by the requirements of stability and homogeneity, particularly if the weight ratio of sulfonates to sulfates is close to 3/2. Moreover, higher amounts are not much more effective either. The preferred amounts are between 6 and 10% by weight. Although both selected detersive surfactants can be used within weight ratios of from 3/2 to 10/1, the preferred compositions herein comprise secondary paraffin sulfonates in major amounts, e.g. whereby the weight ratio of secondary paraffin sulfonates to alkyl sulfates is between 5/1 and 10/1.

The second essential component of the compositions of the present invention is a builder salt. The complete solubilization of the Ca-salts of specific synthetic, organic, anionic detersive surfactants and their stability is to be enhanced by inorganic or organic builder salts. If compounds with Ca-sequestering or precipitating properties but no building properties could be used, provided they are water-soluble at least at the concentration needed, it is highly preferred to use builder salts to complex part of the Ca-ions of the water hardness and to enhance the cleaning power of the specific and elected detersive surfactants in order to obtain maximum efficiency in inorganic soil removal. It is surprising, however, that only from about 3% to about 7.5. % are preferable from about 3% to about 6% of builder salts are needed, which are relatively small amounts if compared with the amounts of builder salts normally present in the usual household cleaners.

Examples of suitable builder salts for use herein include water-soluble, inorganic detergent builder salts such as, for example, the alkali-metal carbonates, borates, phosphates and polyphosphates. Specific examples of the like salts are the sodium and potassium carbonates, sesquicarbonates, tetraborates, tripolyphosphates, pyrophosphates, orthophosphates and hexametaphosphates. Preferred are, because of their Ca-complexing capacity and compatibility with the other components of the composition, sodium and potassium tripolyphosphate and sodium hexametaphosphate most preferably in a weight ratio between 5/1 and 1/1, preferably of about 3/1.

Important examples of suitable water-soluble, organic detergency builder salts to be used in the composition of the present invention are: (a) water-soluble aminopolycarboxylates, e.g., sodium and potassium ethylenediaminetetra-acetate and nitrilotriacetate, (b) water-soluble alkali-metal salts of phytic acid, benzene pentacarboxylic and benzene hexacarboxylic acid, e.g., sodium phytate, pentasodium salt of benzene penta and hexasodium salt of mellitic or hexacarboxylic acid, (c) water-soluble alkali-metal salts of $C_{1-2}$ alkyl diphosphonic acids, e.g. tripotassium salt of ethane-1-hydroxy-1,1-diphosphonic acid, dipotassium salt of methylene diphosphonic acid.

Combinations of organic and inorganic acids can be used in the compositions of the instant invention. However, inorganic builder salts or mixtures containing mainly inorganic builder salts, e.g. above 70% by weight calculated on the total weight of builder salts, are preferred. An additional essential component of the instant invention is a suds depressing system, which is compatible with the other components of said compositions and unique in that it does have no negative impact on the cleaning, soil suspending and physical properties of the specific and elected detersive surfactants, except on foaming, but allows to adjust the foaming characteristics of said composition to any desired and appropriate level, whereby additional rinsing to remove the foam on the cleaned surfaces is avoided. Essential is, however, the presence of both the fatty acid ester $R_3COOR_4$, wherein $R_3$ and $R_4$ have the meaning indicated above, and the water-soluble fatty acid soap in a weight ratio between 1/1 and 1/20, preferably between 1/5 and 1/20, most preferably about 1/10. The minimum amount required to considerably reduce the foam is about 0.3% by weight. With the maximum amount of 3% by weight, calculated on the total weight of the mixture, the foam may practically disappear completely. Since in-between amounts of the suds depressing system reduce the foaming but stabilize the remaining foam, particularly if the ester/soap weight ratio is between 1/5 and 1/20, adding appropriate amounts of said suds depressing system may yield compositions very attractive to the consumer.

Important examples of suds depressing systems suitable for use in the compositions of the present invention are combinations of esters of fatty acids having 12 to 18 carbon atoms, e.g., derived from coconut or tallow oil and ethanol, butanol, isobutanol, propanol and isopropanol, and fatty acid sodium, potassium and ammonium soaps. Preferred are combinations of esters of myristic and stearic acid and isopropanol, and sodium or potassium soap of fatty acids containing from 12 to 14 carbon atoms, whereby the weight ratio ester/soap is about 1/10. The composition of the present invention can be used as such or diluted in water. The dilution water may have any hardness up to 3.5 millimoles/liter (expressed as $CaCO_3$). For optimum performance, the compositions herein are used in hard water, i.e., containing, for example, more than 1.5 millimoles/liter of hardness expressed as $CaCO_3$.

The compositions according to the present invention may, if desired, also contain other components which make them more attractive or provide an additional benefit. The following are mentioned merely by way of example. A tarnish inhibitor such as benzotriazole or ethylene thiourea in amounts up to 1% by weight. Organic solvents such as benzylalcohol, phenylethyl alcohol; ethylene-, propylene-, diethylene- and dipropylene glycol and the mono- and di-$C_{1-4}$ alkyl ether derivatives thereof such as ethylene glycol monobutyl ether, diethylene glycol monoethyl ether, propylene glycol butyl ether and isobutylether, to enhance spot cleaning, particularly if the cleaner composition is used as such. Said organic solvents or mixtures of said solvents can be included in the compositions in amounts up to 7% by weight. Inorganic and organic acids such as phosphoric acid, acetic acid, and/or alkaline buffer agents such as ammonia, triethanolamine to adapt the pH of the compositon to values between 8 and 13. Further, the usual solvents such as ethanol, carbitol ard hydrotropes as sodium and potassium xylene- and toluene sulfonates in amounts up to about 5% by weight. Bactericides, dyes, opacifiers, perfumes but in minor amounts only.

The following examples illustrate the invention. (All percentages are by weight if not specified otherwise.)

EXAMPLE I

| | |
|---|---|
| Sodium salt of secondary paraffin sulfonates containing 14 to 16 carbon atoms | 9.5% |
| Sodium salt of a secondary alcohol sulfate containg 12 to 14 carbon atoms | 1.5% |
| Sodium tripolyphosphate | 2.5% |
| Sodium hexametaphosphate | 0.8% |
| Isopropylmyristate | 0.05% |
| Potassium coconut soap | 0.5% |
| Water | balance |

EXAMPLE II

| | |
|---|---|
| Ammonium salt of secondary paraffin sulfonate containing 12 to 18 with an average of 15 carbon atoms | 12.0% |
| Ammonium salt of alkyl sulfate containing in average 12 to 14 carbon atoms in the alkyl group | 2.5% |
| Tetrapotassium pyrophosphate | 3.5% |

EXAMPLE II-continued

| | |
|---|---|
| Tripotassium salt of ethylene diamine tetra-acetic acid | 0.5% |
| Isobutyl stearate | 0.1% |
| Ammonium soap of fatty acid containing from 12 to 14 carbon atoms | 0.9% |
| Water | balance |

EXAMPLE III

| | |
|---|---|
| Sodium linear alkyl sulfonate containig from 10 to 16 carbon atoms in the alkyl group | 7.5% |
| Sodium salt of alkyl sulfate having in average 12 to 14 carbon atoms in the alkyl group | 3.0% |
| Sodium hexametaphosphate | 2.5% |
| Sodium sesquicarbonate | 0.7% |
| Butanol ester of fatty acid containing from 12 to 14 carbon atoms | 0.4% |
| Coconut potassium soap | 2.0% |
| Ethyleneglycol monobutyl ether | 1.2% |
| Water | balance |

EXAMPLES IV – VIII

| | IV | V | VI | VII | VIII |
|---|---|---|---|---|---|
| Sodium salt of secondary paraffin sulfonate containing 14 to 16 carbon atoms | 10.0 | 8.0 | 12.0 | 6.0 | 5.0 |
| Sodium salt of linear alkyl sulfate containing from 12 to 14 carbon atoms in the alkyl group | 2.5 | 1.5 | 2.0 | 1.0 | 2.5 |
| Sodium tripolyphosphate | — | — | — | 3.0 | — |
| Sodium hexametaphosphate | 4.0 | 4.0 | — | — | 3.0 |
| Tetrapotassium pyrophosphate | — | — | 7.0 | — | — |
| Isopropyl myristate | 0.2 | 0.3 | 0.1 | 0.2 | 0.1 |
| Coconut potassium soap | 1.4 | 1.5 | 1.4 | 0.7 | 1.2 |
| Water | | | balance | | |

What is claimed is:

1. A liquid, homogenous, stable, household cleaner composition, in particular for cleaning hard surfaces, containing anionic detersive surfactants, builder salts, and other usual cleaner additives, consisting essentially of:

A. from about 2% to about 15% by weight of a mixture of a. an anionic, organic, synthetic sulfonate, having the formula $R_1SO_3M$ wherein $R_1$ is selected from the group consisting of alkyl groups containing from 10 to 20 carbon atoms, and wherein M represents a cation selected from the group consisting of sodium, potassium, ammonium and ethanol ammonium; and b. an anionic, organic synthetic sulfate having the formula $R_2SO_4M$ wherein $R_2$ is selected from the group consisting of saturated or unsaturated, straight or branched aliphatic hydrocarbon groups containing from 8 to 18 carbon atoms, and M has the meaning given above;

whereby the weight ratio of (a) to (b) is between 3/2 and 10/1;

B. from about 3% to about 7.5% by weight of a water-soluble, organic or inorganic builder salt; and mixtures thereof;

C. from about 0.3% to about 3% by weight of a suds depressing system comprising a fatty ester of the general formula $R_3COOR_4$, wherein $R_3$ is an alkyl radical containing from 11 to 17 carbon atoms and $R_4$ is an alkyl radical containing from 2 to 4 carbon atoms; and sodium, potassium or ammonium soap of a fatty acid containing from 12 to 18 carbon atoms; whereby the ester/soap weight ratio is between 1/1 and 1/20; and D. water;

wherein the weight ratio of (A) to (B) is between 5/1 and 1/2.

2. A cleaner composition according to claim 1 wherein the anionic, organic, synthetic detersive sulfonate is a secondary paraffin sulfonate having 14 to 16 carbon atoms.

3. A cleaner composition according to claim 2 wherein the weight ratio of secondary paraffin sulfonates to organic synthetic sulfate is between 5/1 and 10/1.

4. A cleaner composition according to claim 1, wherein the anionic, organic, synthetic detersive sulfate is an alkyl sulfate having from 12 to 14 carbon atoms.

5. A cleaner composition according to claim 1 wherein the builder salt comprises from about 3 to about 6% by weight of a mixture of sodium tripolyphosphate and sodium hexametaphosphate in a weight ratio of from about 5/1 to about 1/1.

6. A cleaner composition according to claim 1 wherein the suds depressing system is present in an amount of from about 0.6 to about 1.5% and comprises a fatty acid ester of myristic acid and butanol, propanol or isopropanol, and a sodium, potassium or ammonium coconut soap, wherein the ester/soap weight ratio is between 1/5 and 1/20.

7. A cleaner composition according to claim 6 wherein the suds depressing system comprises from about 0.4 to about 0.8% by weight of a coconut potassium soap and from about 0.05 to about 0.2% of isopropyl myristate, wherein the ester/soap weight ratio is about 1/10.

8. A cleaner composition according to claim 1 wherein the weight ratio of the anionic, organic, synthetic detersive surfactant to builder salts is between 3/1 and 1/1.

* * * * *

UNITED STATES PATENT OFFICE

CERTIFICATE OF CORRECTION

PATENT NO. : 4,017,409

DATED : April 12, 1977

INVENTOR(S) : E. Demessemaekers, G. Bognolo and G. Spadini

It is certified that error appears in the above-identified patent and that said Letters Patent are hereby corrected as shown below:

Column 5, line 2, delete "are"

Column 7, line 60, after "fatty" insert -- acid --.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*